US006743573B1

(12) United States Patent
Helber et al.

(10) Patent No.: US 6,743,573 B1
(45) Date of Patent: Jun. 1, 2004

(54) BLACK AND WHITE SILVER HALIDE DISPLAY ELEMENTS HAVING GOOD LIGHT STABILITY

(75) Inventors: Margaret J. Helber, Rochester, NY (US); Charles H. Vogt, Fairport, NY (US); David T. Southby, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/356,823

(22) Filed: Feb. 3, 2003

(51) Int. Cl.[7] ..... G03C 1/775; G03C 1/83; G03C 1/91; G03C 1/79

(52) U.S. Cl. ..... 430/519; 430/523; 430/538

(58) Field of Search ..... 430/519, 538, 430/523

(56) References Cited

U.S. PATENT DOCUMENTS

| | | | | | |
|---|---|---|---|---|---|
| 2,805,161 | A | * | 9/1957 | Wood | 430/538 |
| 3,096,231 | A | * | 7/1963 | Griggs et al. | 430/538 |
| 5,478,693 | A | * | 12/1995 | Hirai | 430/519 |
| 5,558,973 | A | * | 9/1996 | Yamada | 430/519 |
| 5,559,216 | A | * | 9/1996 | Jung et al. | 534/579 |
| 5,616,778 | A | * | 4/1997 | Goldmann et al. | 560/35 |
| 6,261,733 | B1 | * | 7/2001 | Coppens et al. | 430/519 |

* cited by examiner

*Primary Examiner*—Richard L. Schilling
(74) *Attorney, Agent, or Firm*—Sarah Meeks Roberts

(57) ABSTRACT

This invention provides a black and white silver halide photographic display element comprising a support and a layer on top of said support comprising baryta and a yellow pigment represented by Formula I

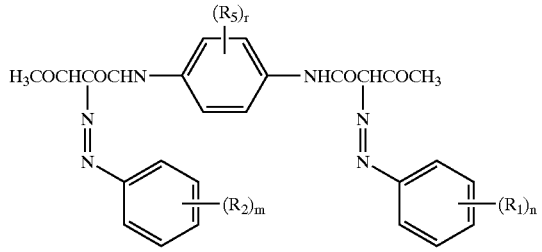

wherein each of $R_1$, $R_2$, and $R_5$ independently represents a halogen atom, or a substituted or unsubstituted alkyl, alkenyl, aryl, aralkyl, cycloalkyl, alkoxy, or alkyl amino group of 1 to 8 carbon atoms, or a substituted or unsubstituted aminocarbonyl, alkoxycarbonyl or alkylthio group of 2 to 10 carbon atoms, or a substituted or unsubstituted alkylsulfonyl, arylsulfonyl or sulfamoyl group of 1 to 8 carbon atoms, or a nitro, amino, acetamido, hydroxy, cyano, carboxy, carboxylate, sulfonic acid, or sulfonate group, additionally pairs of $R_1$ or $R_2$ may represent the non-metallic atoms necessary to complete a substituted or unsubstituted ring system containing at least one 5- or 6-membered heterocyclic or carbocylic fused ring; and n, m and r are independently 0 to 5.

12 Claims, No Drawings

BLACK AND WHITE SILVER HALIDE DISPLAY ELEMENTS HAVING GOOD LIGHT STABILITY

FIELD OF THE INVENTION

This invention relates to the use of light stable pigments incorporated in an aqueous coating for photographic supports utilized in silver halide black and white photographic display elements, preferably black and white paper. These papers are typically used in advertising, portraiture, fine art, and restoration applications.

BACKGROUND OF THE INVENTION

Fiber-based photographic papers are typically coated with baryta to obtain a smooth high-reflectance surface as a base for light sensitive photographic layers. In order to provide warm tone, cream colored paper supports, yellow and red colored pigments are incorporated in either the paper base fibers or more typically in the baryta layer.

Often warm tone tinted papers exposed to normal room light conditions fade with time. When this occurs, the aesthetic properties associated with creamy colored papers are lost. Therefore, it is desired to provide a black and white silver halide photographic display material which does not fade after long-term exposure to light.

SUMMARY OF THE INVENTION

This invention relates to a black and white silver halide photographic display element comprising a support and a layer on top of said support comprising baryta and a yellow pigment represented by Formula I

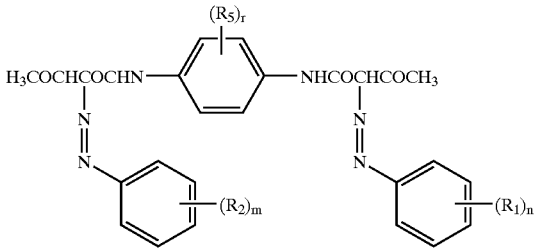

wherein each of $R_1$, $R_2$, and $R_5$ independently represents a halogen atom, or a substituted or unsubstituted alkyl, alkenyl, aryl, aralkyl, cycloalkyl, alkoxy, or alkyl amino group of 1 to 8 carbon atoms, or a substituted or unsubstituted aminocarbonyl, alkoxycarbonyl or alkylthio group of 2 to 10 carbon atoms, or a substituted or unsubstituted alkylsulfonyl, arylsulfonyl or sulfamoyl group of 1 to 8 carbon atoms, or a nitro, amino, acetamido, hydroxy, cyano, carboxy, carboxylate, sulfonic acid, or sulfonate group, additionally pairs of $R_1$ or $R_2$ may represent the non-metallic atoms necessary to complete a substituted or unsubstituted ring system containing at least one 5- or 6-membered heterocyclic or carbocylic fused ring; and n, m, and r are independently 0 to 5.

Colorimetric testing indicated that typical yellow pigments degrade significantly under room light conditions. This invention relates to the use of yellow pigments that offer long-term light stability when incorporated in baryta coatings for photographic fiber base papers. This invention provides a baryta layer that will not fade under long-term exposure to light. Therefore, the support material maintains its intended "creamy" color.

DETAILED DESCRIPTION OF THE INVENTION

The photographic elements of the invention are silver halide black and white photographic display elements and more preferably silver halide black and white papers. Most preferably they are professional quality papers where the tone of the support is particularly important. Examples of current papers which could suitably incorporate the improved baryta layer described hereafter include KODAK POLYMAX Fine Art Paper.

The black and white elements of the invention comprise a support. The support may be made of any suitable material as known to those skilled in the art. Preferably the support is comprised of cellulose paper fibers. In order to achieve a highly reflective photographic surface for the light sensitive photographic emulsions, a layer comprising baryta layer is applied on top of the support. The phrase "on top of the support" means between the support and the imaging layers. There may be other layers in between the baryta layer and the support such as adhesion layers or barrier layers. There may also be additional layers between the baryta layer and the imaging layers.

Baryta refers to barium sulfate, a highly reflective white pigment. The binder for the barium sulfate is typically, but not exclusively gelatin. Other coating aids, surfactants, colorants, optical brighteners, and inorganic or organic cross-linking agents may be employed to support the manufacturing operations and provide for physical and aesthetic properties specific for product requirements. A typical baryta layer is comprised of 70–95% by dry weight barium sulfate, and 5–30% gelatin. These layers are applied to a photographically inert paper base and typically range from 10 to 60 grams per square meter in coverage.

The baryta layer utilized in the invention also comprises a yellow pigment represented by Formula I (I)

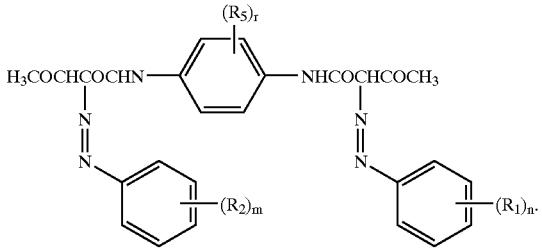

$R_1$, $R_2$, and $R_5$ are substituents. Preferably each of $R_1$, $R_2$, and $R_5$ independently represents a halogen atom, or a substituted or unsubstituted alkyl, alkenyl, aryl, aralkyl, cycloalkyl, alkoxy, or alkylamino group of 1 to 8 carbon atoms; or a substituted or unsubstituted aminocarbonyl, alkoxycarbonyl or alkylthio group of 2 to 10 carbon atoms; or a substituted or unsubstituted alkylsulfonyl, arylsulfonyl or sulfamoyl group of 1 to 8 carbon atoms; or a nitro, amino, acetamido, hydroxy, cyano, carboxy, carboxylate, sulfonic acid, or sulfonate group. Additionally pairs of $R_1$ or $R_2$ may represent the non-metallic atoms necessary to complete a substituted or unsubstituted ring system containing at least one 5- or 6-membered heterocyclic or carbocylic fused ring.

Examples of unsubstituted alkyl groups are methyl, ethyl, propyl, isopropyl, butyl, isobutyl, t-butyl, pentyl, hexyl, octyl, 2-ethylhexyl, and the like. Cycloalkyl groups can be cyclopentyl, cyclohexyl, 4-methylcyclohexyl, and the like.

Alkenyl groups can be vinyl, 1-propenyl, 1-butenyl, 2-butenyl, and the like. Aryl groups can be phenyl, naphthyl, styryl, and the like. Aralkyl groups can be benzyl, phenethyl, and the like. Particularly useful substituents for these groups include halogen, alkoxy, acyl, alkoxycarbonyl, aminocarbonyl, carbonamido, carboxy, sulfamoyl, sulfonamido, sulfo, nitro, and the like.

Preferably each $R_1$, $R_2$, and $R_5$ independently represents a halogen atom or an alkoxycarbonyl or alkyl group. In one suitable embodiment each $R_1$ and $R_2$ independently represents a halogen atom or an alkoxycarbonyl group. It is preferred that $R_1$ and $R_2$ are the same and that n=m. $R_5$, when present, is preferably alkyl or halogen.

n, m, and r are independently 0 to 5, and more preferably n and m are 1 to 5 in order to provide a pigment with improved properties. In a preferred embodiment n and m are 1 or 2. In one embodiment r is 0. In one preferred embodiment, $R_1$ and $R_2$ are methoxycarbonyl ($CO_2Me$) and r is 0.

Examples of suitable pigments include the following, with Inventive Pigment 1 being most preferred.

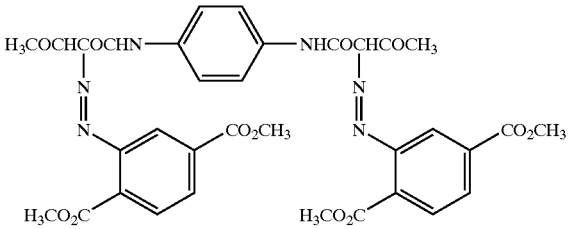

Inventive Pigment 1

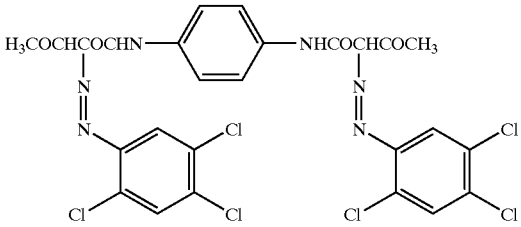

Inventive Pigment 2

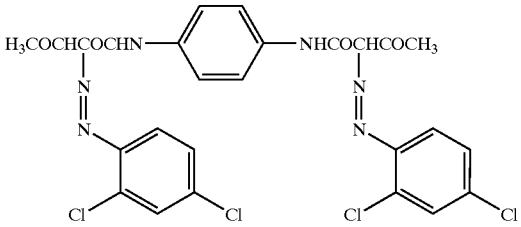

Inventive Pigment 3

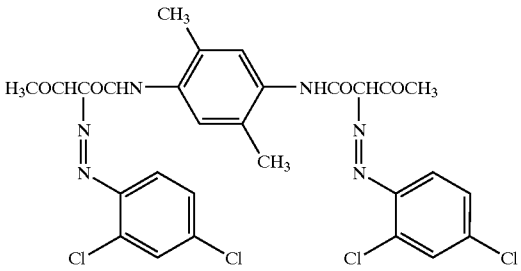

Inventive Pigment 4

-continued

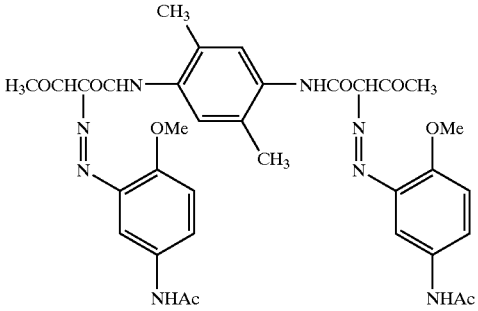

Inventive Pigment 5

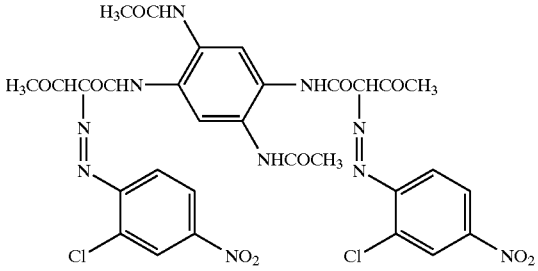

Inventive Pigment 6

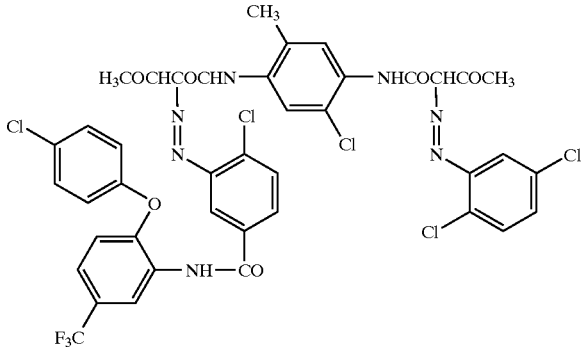

Inventive Pigment 7

The pigments can be used in any amount which provides the appropriate color aim. In one suitable embodiment a lay down of 1 to 10 mgs per square meter may be utilized. The disazo pigments described herein for use in the invention materials are well known yellow pigments (see GB 2,356,866 and U.S. Pat. No. 5,559,216) and their method of preparation is well known to those skilled in the art. The pigments have excellent qualities for use as inks and colorants, such as transparency, and color strength. In this application, the Formula I pigments exhibit excellent light stability and fastness as compared with other pigments used in the commercial trade.

Combinations of pigments of Formula I may be used. Further, the pigments of Formula I may be used alone or in combination with other pigments to produce the desired tinting color for the support material. Any companion pigments may be used, but a red colored pigment is preferred. Especially preferred is the combination of Inventive Pigment 1 with Flexonyl Red

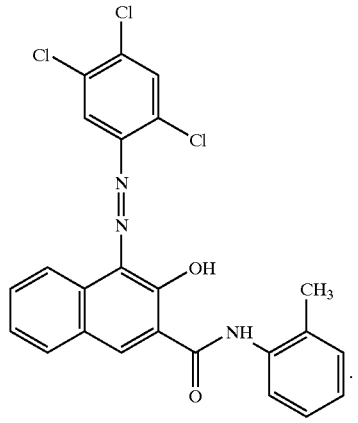

Flexonyl Red

Pigments are colorants which are considered to be effectively insoluble in the application medium, and many such compounds are well known and in wide commercial use. It is common practice to provide pigment compositions in the form of finely divided dispersions, which may be produced by well-known methods such as ball milling, media milling, or by the methods disclosed in U.S. Pat. Nos. 5,026,427 and 5,310,778 incorporated herein by reference.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy)propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfanoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy) butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy, sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylanidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc.

The display elements of the invention also comprise at least one silver halide emulsion layer. The photographic emulsions of this invention are generally prepared by precipitating silver halide crystals in a colloidal matrix by methods conventional in the art. The colloid is typically a hydrophilic film-forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment. After spectral sensitization, the emulsion is coated on a support. Various coating techniques include dip coating, air knife coating, curtain coating, and extrusion coating.

The silver halide emulsions utilized in this invention may be comprised of, for example, silver bromide, silver chloride, silver bromochloride, silver iodochloride, silver bromoiodochloride and silver iodobromochloride enulsions. The silver halide emulsions are preferably bromochloride emulsions. In one suitable embodiment, the grains of the emulsion are equal to or greater than about 50 mole percent silver chloride. It is preferred that the emulsions do not contain iodide.

It is contemplated that the silver halide emulsions may take the form of a variety of morphologies including those with cubic, tabular, and tetradecahedral grains with {111} and {100} crystal faces. The grains may take the form of any of the naturally occurring morphologies of cubic lattice type silver halide grains. Further, the grains may be irregular such as spherical grains.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin) or acid treated gelatin (pigskin gelatin) and gelatin derivatives—e.g., acetylated gelatin, phthalated gelatin, and the like are specifically contemplated. When used, gelatin is preferably at levels of 0.01 to 100 grams per total silver mole The photographic elements of the invention are black-and-white elements. The supports utilized in this invention are generally reflective supports such as are known in the art. The silver halide emulsion layer can be comprised of sub layers. It can also be comprised of more than one silver halide emulsion. The layers of the element, including the image forming layers, can be arranged in various orders as known in the art. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire PO10 7DQ, ENGLAND, the contents of which are incorporated herein by reference.

In the following Table, reference will be made to (1) *Research Disclosure*, December 1978, Item 17643; (2) *Research Disclosure*, December 1989, Item 308119; (3) *Research Disclosure*, September 1994, Item 36544; and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 & 4 | I, II, III, IX A & B | including hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical brighteners, |
| 2 | V | luminescent dyes |
| 3 & 4 | VI | |
| 1 | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The following examples illustrate the practice of this invention. They are not intended to be exhaustive of all possible variations of the invention. Parts and percentages are by weight unless otherwise indicated.

EXAMPLES

Example 1

Evaluation Methods

As a surrogate for studying the stability of pigments when they are included in baryta layers by intimate mixing during paper manufacture, pigment dispersions were printed onto commercial Baryta papers using inkjet technology, and the stability of the various pigments to fading by light and to fading by atmospheric pollutants was compared. The behavior of the pigments was modeled by printing them onto commercially available inkjet receiver papers. Stability testing on these receivers was found to be useful in reproducing the problem with Comparative Pigment A and in confirming the improvement shown by the inventive pigments.

Preparation of Inks for Printing.

Ink C-1, Comparative Pigment A.

The commercial slurry of Comparative Pigment A (NCG-LA, Flexonyl Yellow, shown below) (10 g) was diluted with water (5 g) and stirred in a media mill with 0.1 mm diameter, Zirconia/Silica beads (18 g) at 2300 rpm for 4 h. The resulting slurry was filtered free of beads to give the starting mill-grind. A portion of this mill-grind (1.3 g) was stirred one hour with water (3.7 g) and 5 g of a solution of tetraethylene glycol (30%), 2-pyrrolidinone(16%), 1,2-hexanediol (7%) and Surfynol® 465 surfactant (Air Products) (1%) in water. The resulting mixture was filtered through a 0.45 μm filter pad, then loaded into a Lexmark cartridge, No. 15MO120, to be printed using a Lexmark Z51® printer.

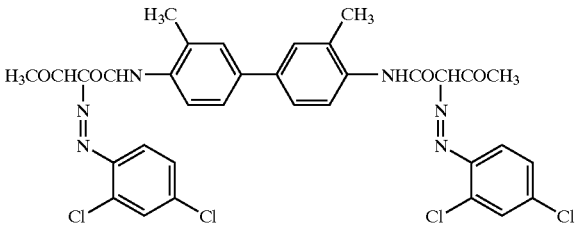

Comparative Pigment A
Flexonyl Yellow

Ink (1) (Inventive Pigment 1)

Pigment Yellow 155 (Inventive Pigment 1) mill-grind (10% PY155) (2.47 g), potassium N-octyl, N-methyltaurine (0.03 g), Diethylene glycol (1.2 g), Proxel® GXL (Zeneca Specialities Co.), (30 ppm), Strodex™ PK-90 surfactant (Dexter Chemicals) (0.04 g), Rhodocal™ DS-4 (Rhodia), (0.51 g of 22.5% active aqueous solution), and water to 10 g were mixed and filtered through a 0.45 μm filter pad, then loaded into a Lexmark cartridge, No. 15MO120, to be printed using a Lexmark Z51® printer.

Evaluation

Various test targets were printed, using a variety of ink jet receiving and baryta paper elements, to allow examination of several density level patches (approx. 10 mm square) ranging from 100% dot coverage to less than 25% dot coverage. Printed samples were then subjected to image stability testing under a variety of conditions. These tests are described below. Typically the Status A blue reflection density of the 100% dot coverage (or other) patch on a fresh sample was measured using an X-Rite 820® densitometer, corrected if required, for the color of the receiver, and recorded. That sample was subjected to a test described below and re-read. The percentage of dye density remaining relative to the fresh sample was calculated, to give a measure of colorant fastness on a particular receiver. These data are given in the Tables below.

Atmospheric Contaminants Test

Printed samples were mounted in a darkened chamber maintained at room temperature, with a constant atmosphere containing 5 ppm of Ozone, and at a relative humidity of approximately 50%. The samples were removed after a time period of 24 hours.

High Intensity Simulated Daylight Fading (HID) Test

Samples were mounted in a temperature and humidity controlled chamber where they were subjected to 50 Klux light exposure from a filtered xenon light source, designed to match the spectral characteristics of daylight, for a time period of two weeks.

High Intensity Filtered Fluorescent Light Fading (HIF) Test

Samples were mounted in a temperature and humidity controlled chamber where they were subjected to 80 Klux light exposure from UV filtered fluorescent tubes for a time period of two weeks.

Paper Receiving Elements

The following commercially available Inkjet receiving element was used:

Receiver 1

Kodak Professional Inkjet Products, Inkjet Photo Paper, CAT 118-1197. Other receiver elements used were:

Receiver 2

Baryta Paper with 35 gm/m$^2$ Baryta coating on a 250 gm/m$^2$ neutral sized, optically brightened, white photographic raw paper support.

Receiver 3

Baryta Paper with C.I. Direct Yellow 127 in the raw paper base.

Receiver 4

Baryta Paper with Comparative Pigment A in the Baryta coating

Receiver 5

Baryta paper with Inventive Pigment 1 in the Baryta coating.

Results

| Ink | Receiver | HID Fade Test % Density Retained | HIF Fade Test % Density Retained | Atmospheric Contaminants Test % Density Retained |
|---|---|---|---|---|
| 1 | 1 | 97% | 97% | 99% |
| 1 | 2 | 100% | 100% | 101% |
| C-1 | 1 | 73% | 93% | 95% |
| C-1 | 2 | 74% | 96% | 94% |

These data show that the inventive pigment in ink (1) has improved High Intensity Daylight stability over the comparison (C-1), whilst maintaining (at least equaling) the good Fluorescent Light fade and atmospheric contaminants fade properties of the comparison.

Demonstration of the Light Fade Problem

Samples of Baryta paper containing the pigments of the prior art were subjected to the HID, HIF, and Atmospheric Contaminants tests to confirm that what is shown by Inkjet printing is equivalent to the known problem. Results are shown below.

| Receiver | Pigment Placement | HID Fade Test % Density Retained | HIF Fade Test % Density Retained | Atmospheric Contaminants Test % Density Retained |
|---|---|---|---|---|
| 3 | In paper base | 71% | 86% | 100% |
| 4 | In Baryta layer | 50% | 72% | 97% |

These data show that the largest problem is the HID fade especially when the pigmentation is sited in the Baryta layer (Paper 2), near the surface of the paper. The inventive pigments solve this problem.

Production Verification of the Invention

Commercial samples of Baryta paper containing (a) Comparative Pigment A (Receiver 4) or (b) Inventive Pigment 1 (Receiver 5) from production runs were evaluated using the tests described above. The results are summarized in the following tables and confirm the improvements in stability and lower change in color (Delta $E_{ab}$) resulting from the inventive use of the Pigment Yellow 155.

| Receiver | Pigment | HID Fade Test % Density Retained | HIF Fade Test % Density Retained | HIF Fade Test-extended to 4 weeks % Density Retained | Atmospheric Contaminants Test % Density Retained |
|---|---|---|---|---|---|
| 4 | CP A | 50% | 67% | 50% | 100% |
| 5 | IP 1 | 67% | 83% | 83% | 100% |

Changes in Color after incubation as defined in CIE (Commission Internationale de l'Eclairage) color space mapping system.

| Receiver | Pigment | HID Fade Test Delta $E_{ab}$ | HIF Fade Test Delta $E_{ab}$ | HIF Fade Test - extended to 4 weeks Delta $E_{ab}$ | Atmospheric Contaminants Test Delta $E_{ab}$ |
|---|---|---|---|---|---|
| 4 | CP A | 2.76 | 2.03 | 2.78 | 0.14 |
| 5 | Ip 1 | 1.30 | 0.69 | 0.98 | 0.09 |

The invention has been described in detail with particular reference to certain preferred embodiments thereof, but it will be understood that variations and modifications can be effected within the spirit and scope of the invention.

What is claimed is:

1. A black and white silver halide photographic display element comprising a support and a layer on top of said support comprising baryta and a yellow pigment represented by Formula I

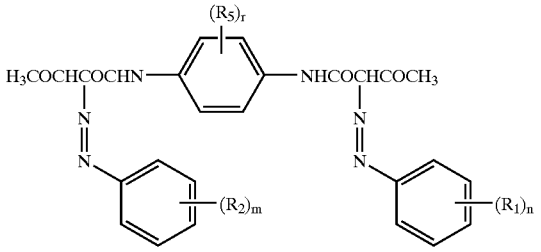

wherein each of $R_1$, $R_2$, and $R_5$ independently represents a halogen atom, or a substituted or unsubstituted alkyl, alkenyl, aryl, aralkyl, cycloalkyl, alkoxy, or alkylamino group of 1 to 8 carbon atoms; or a substituted or unsubstituted aminocarbonyl, alkoxycarbonyl or alkylthio group of 2 to 10 carbon atoms; or a substituted or unsubstituted alkylsulfonyl, arylsulfonyl or sulfamoyl group of 1 to 8 carbon atoms; or a nitro, amino, acetamido, hydroxy, cyano, carboxy, carboxyl ate, sulfonic acid, or sulfonate group; additionally pairs of $R_1$ or $R_2$ may represent the non-metallic atoms necessary to complete a substituted or unsubstituted ring system containing at least one 5- or 6-membered heterocyclic or carbocylic fused ring; and n, m and r are independently 0 to 5.

2. The black and white silver halide display element of claim 1 wherein each $R_1$, $R_2$, and $R_5$ independently represents a halogen atom or an alkoxycarbonyl or alkyl group.

3. The black and white silver halide display element of claim 2 wherein each $R_1$ and $R_2$ independently represents a halogen atom or an alkoxycarbonyl group.

4. The black and white silver halide display element of claim 1 wherein n and m are 1 or 2.

5. The black and white silver halide display element of claim 2 wherein n and m are 1 or 2.

6. The black and white silver halide display element of claim 3 wherein n and m are 1 or 2.

7. The black and white silver halide display element of claim 3 wherein the yellow pigment is

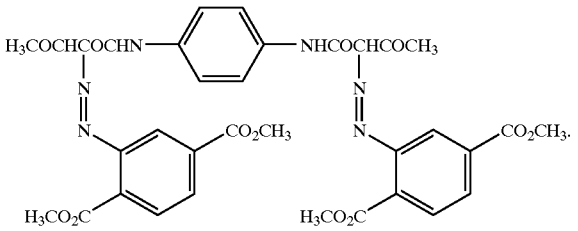

8. The black and white silver halide display element of claim 1 wherein the baryta layer further comprises a red pigment represented by the following structure:

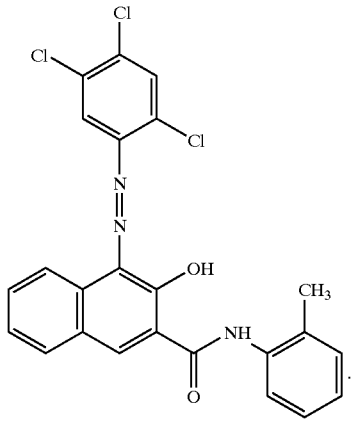

9. The black and white silver halide display element of claim 7 wherein the baryta layer further comprises a red pigment represented by the following structure:

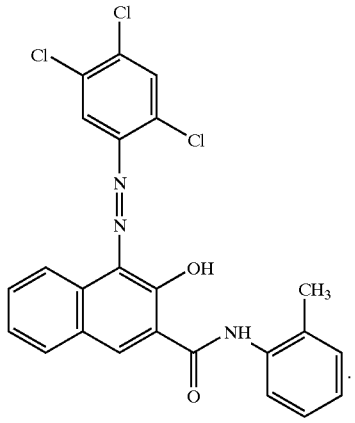

10. The black and white silver halide display element of claim 1 wherein n equals m.

11. The black and white silver halide display element of claim 3 wherein n equals m.

12. The black and white silver halide display element of claim 6 wherein n equals m.

* * * * *